United States Patent [19]

Cannon

[11] Patent Number: 4,679,622

[45] Date of Patent: Jul. 14, 1987

[54] TAKE-APART FITTING FOR MULTI-TUBE HEAT EXCHANGER

[75] Inventor: Robert B. Cannon, Gulf Shores, Ala.

[73] Assignee: Robert B. Cannon, Inc., Gulf Shores, Ala.

[21] Appl. No.: 727,294

[22] Filed: Apr. 25, 1985

[51] Int. Cl.[4] ..... F28D 7/10

[52] U.S. Cl. ..... 165/154; 138/114; 285/367; 285/411

[58] Field of Search ..... 165/141, 143, 154; 138/114; 285/138, 367, 411

[56] References Cited

U.S. PATENT DOCUMENTS

| | | | |
|---|---|---|---|
| 2,410,912 | 11/1946 | Wenk | 165/154 X |
| 2,449,052 | 9/1948 | Brown, Jr. | 165/143 X |
| 2,712,438 | 7/1955 | Brown, Jr. | 165/154 |
| 3,207,533 | 9/1965 | Van Gundy et al. | 138/114 X |
| 3,386,497 | 6/1968 | Feldmeier | 165/154 X |
| 3,651,551 | 3/1972 | Cannon | 165/141 |
| 3,938,233 | 2/1976 | Cannon | 138/114 X |
| 3,997,002 | 12/1976 | Baker et al. | 165/154 |
| 4,094,358 | 6/1978 | Neveux | 165/154 |
| 4,502,533 | 3/1985 | Nielsen | 165/154 |

FOREIGN PATENT DOCUMENTS

| | | | |
|---|---|---|---|
| 535962 | 1/1957 | Canada | 138/114 |

*Primary Examiner*—Albert W. Davis, Jr.
*Assistant Examiner*—Peggy Neils
*Attorney, Agent, or Firm*—kane, Dalsimer, Kane, Sullivan and Kurucz

[57] ABSTRACT

A multitube heat exchanger is provided with a take-apart fitting. The fitting is coupled to one end of the exchanger product tube. A cap ring is secured to the inner tube of the exchanger. An end cap adapted to seal against the cap ring is secured to the fitting. A split ring clamp serves to urge the end cap against the cap ring by virtue of a chamfered surface on the clamp urging against a complementary chamfer of the end cap.

9 Claims, 5 Drawing Figures

TAKE-APART FITTING FOR MULTI-TUBE HEAT EXCHANGER

BACKGROUND OF THE INVENTION

The present invention relates to multi-tube heat exchangers and in particular to a readily removable inlet/-outlet fitting for such a heat exchanger.

In U.S. Pat. No. 3,938,233 there is disclosed an all welded multitube heat exchanger in which product flows through the intermediate of three concentric tubes and heating or cooling fluids flow through the inner and outer tubes to heat or cool the product.

Heat exchangers of the type described in U.S. Pat. No. 3,938,233 are highly sanitary, efficient and provide an extremely practical heat transfer apparatus for the processing of free flowing products. As a result, such heat exchangers are widely used in the food, pharmaceutical and chemical industries. There is, however, one shortcoming of this all welded type of heat exchanger where high viscosity liquids or liquids containing small particles are to be processed. Such liquids have a tendency to plug the product tube and heretofore it has been difficult to clear such plugs because of lack of access. The principal reason for this is that the prior construction did not provide for full exposure of the flow area of the product tube at the inlet and outlet ports.

In view of the above, it is the principal object of the present invention to provide an improved inlet and/or outlet fitting for a concentric tube heat exchanger which can be readily taken apart and removed to expose the fluid product channels at the inlet and/or outlet flow area of the product tube thus allowing for an unobstructed, concentric flow area into and/or from the product zone in the event it became necessary to flush or purge the product tube.

A further object is to provide such a fitting which allows for the complete 360° orientation of the product inlet and/or outlet port without any change in the installed position of the heat exchanger.

A further object is to provide such a fitting which insures a complete seal and separation between the product tube and the exchange fluid tubes to insure against cross contamination.

A still further object is to provide such a fitting which holds the tubes of the heat exchanger tight and secure at the point of connection and prevents any movement.

Yet another object is to provide such a fitting which utilizes conventional commercially obtainable components requiring relatively minor modifications.

Still other objects and advantages will become apparent from the following description of my invention.

SUMMARY OF THE INVENTION

The above and other beneficial objects and advantages are attained by providing a multitube heat exchanger comprising an inner tube and a concentric outer tube. An end piece for the outer tube comprises a length of tubing having an outwardly directed end adapted to be mechanically connected to an end of the outer tube; a product port; and an outwardly directed end adapted to be mechanically connected to and sealed to the inner tube. To this end, a clamp ring and a cap ring are welded to the exterior of the inner tube with the cap ring being spaced longitudinally inwardly of the clamp ring. An end cap ring is welded to the longitudinally outwardly directed end of the end piece. The bore of the end cap ring is sufficiently large to permit the inner tube of the heat exchanger to freely pass.

The end cap has a longitudinally inwardly directed end surface adapted to seal against the cap ring and a longitudinally outwardly directed end surface machined to a chamfer.

A split clamp is positioned about the inner tube. The clamp has a longitudinally inwardly directed end surface machined to a chamfer complementary to that of the end cap chamfer and a radially inner surface containing a groove adapted to capture the clamp ring.

When assembled, as the clamp is tightened its chamfered surface acts against the end cap chamfered surface to urge the end cap longitudinally inwardly to thereby provide a tight leak-proof seal by seating the inner surface of the end cap against the outer surface of the cap ring or against a suitable gasket material.

DETAILED DESCRIPTION OF THE PREFERRED EMBODIMENT

Figure 1:
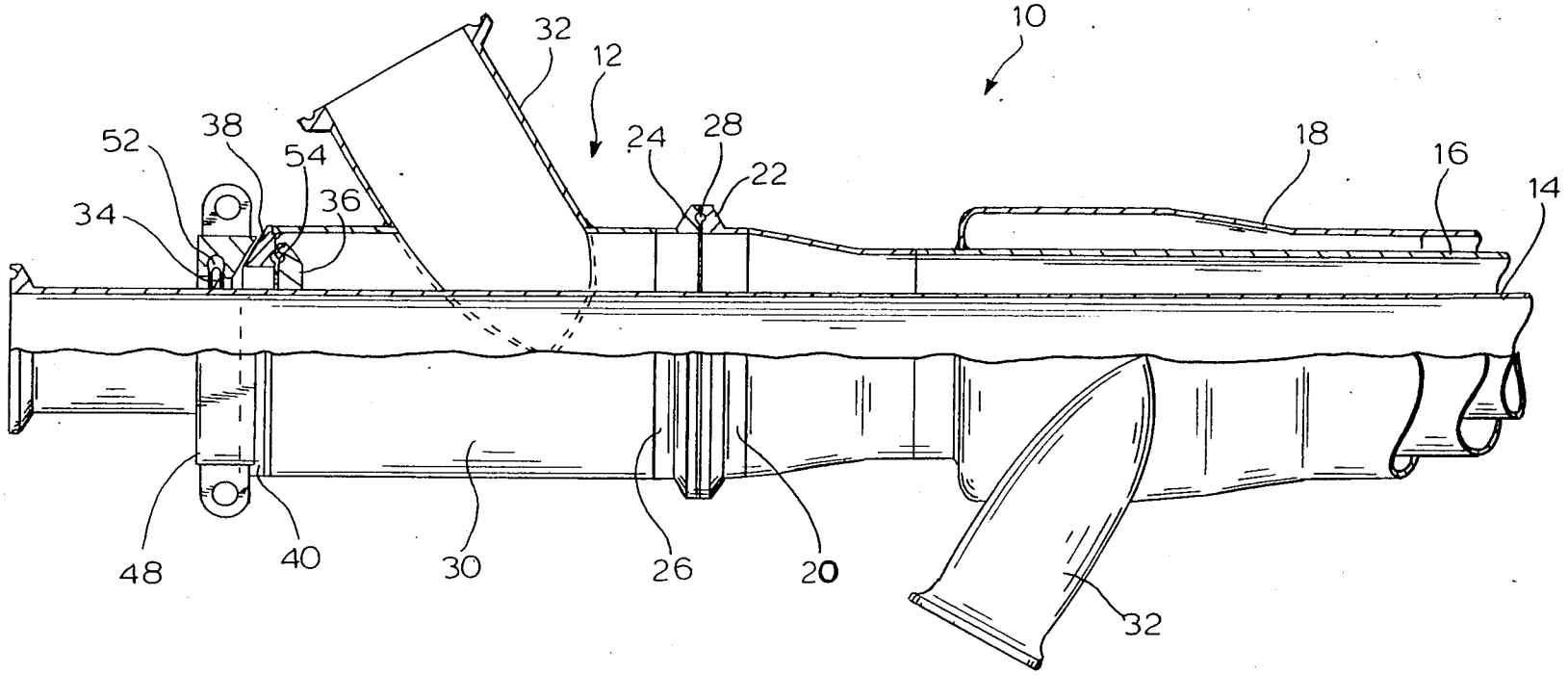
FIG. 1 is a side elevational, partial sectional view of an inlet/outlet fitting on a multi-tube heat exchanger in accordance with the present invention.
Figure 4:
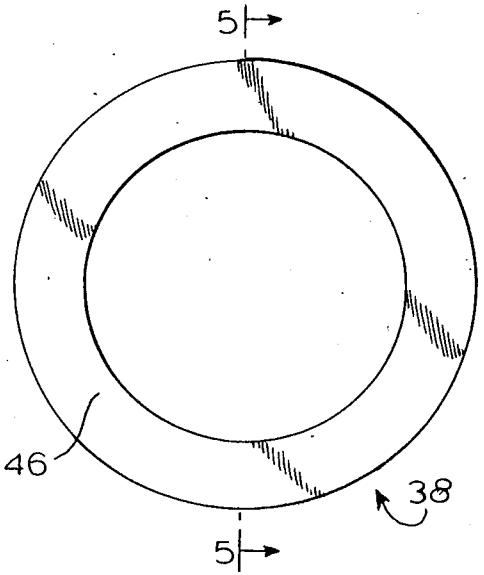
FIG. 4 is a plan view of the cap ring of the present fitting.

Reference is now made to the drawings and to FIG. 1 in particular wherein the fitting 12 of a multitube heat exchanger 10 is shown. The heat exchanger 10 comprises a first or inner tube 14 and a concentric second tube 16. A third concentric tube 18 may also be provided. The second or intermediate tube 16 carries the product to be heated or chilled while the inner and outer tubes, 14 and 18, carry the heat exchange fluids. The assembly of the heat exchanger may be as described in U.S. Pat. No. 3,938,233. The fitting 12 is secured to an end 20 of the intermediate tube 16. To this end a first ferrule 22 is welded to the end 20 and a similar ferrule 24 is welded to the inner end 26 of the fitting 12. A flanged gasket 28 is positioned between the ferrules 22, 24 and a clamp holds the assembly together.

The fitting 12 comprises an elongated section of tubing 30 which contains a product port 32 between its ends. To secure the fitting in position a clamp ring 34 is welded to the outer surface of the inner tube 14 and an end cap ring 36 is also welded to the inner tube spaced longitudinally inwardly from the clamp ring 34. The cap ring 36 comprises a standard tube end cap drilled to fit over the inner tube 14.

Figure 5:
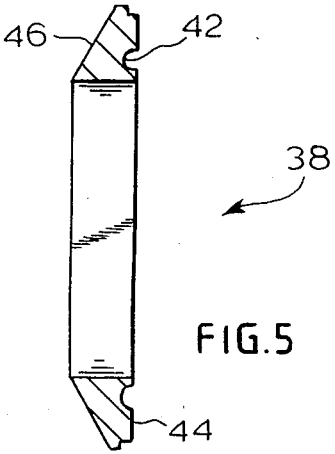
FIG. 5 is a side elevational view of the cap ring taken along reference line 5—5 of FIG. 4.
Figure 3:
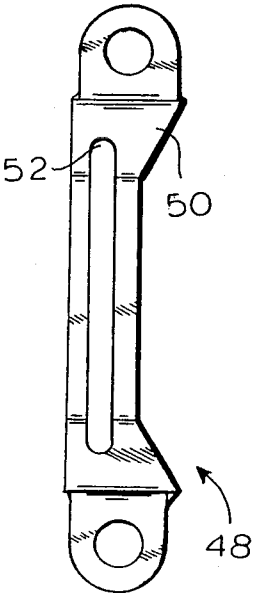
FIG. 3 is a side elevational view of a portion of the split clamp.
Figure 2:
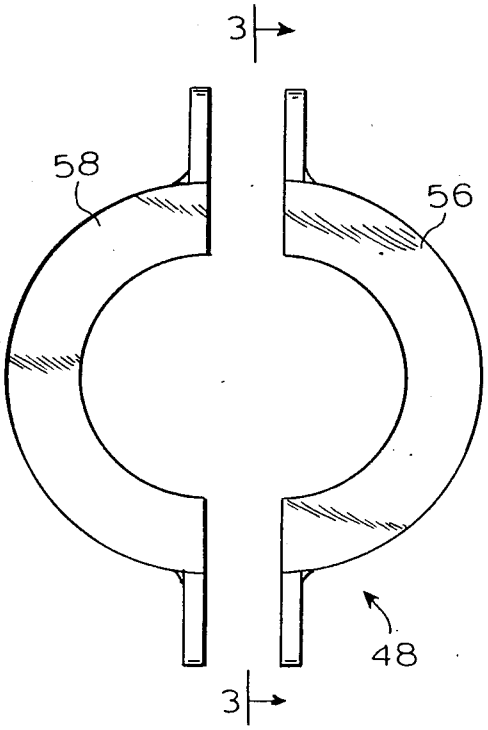
FIG. 2 is a plan view of the split clamp utilized by the fitting.

A similar end cap 38 is welded to the outward end 40 of the tube 30. As shown in FIG. 5 a gasket groove 42 is cut on the inwardly directed face 44 of cap 38. In addition, the outwardly directed face 46 is machined to a 30° chamfer. A split clamp 48 is provided to hold the assembly together. Clamp 48 has an inwardly directed face 50 machined at an angle of 60° so that the chamfer of the clamp complements that of end cap 38. A groove 52 is machined into the inner surface of the clamp 48.

The diameter of groove 52 is sufficient to receive the clamp ring 34.

To assemble the fitting 12 to the heat exchanger the ferrules 22, 24 and the gasket 28 are positioned and tightened together. A gasket 54 is then fitted into the gasket grooves of the cap ring 36 and the end cap 38. The halves 56, 58 of the clamp 48 are then fitted over ring 34. As the clamp 48 is tightened the chamfered face 50 of the clamp rides against the chamfered face 46 of end cap 38 thereby forcing the end cap into sealing engagement with the cap ring 38 through the gasket 54. As previously mentioned the various ferrules 22, 24; caps 36, are commercially available standard stock items as are the various gaskets. Such items are available, for example, from the Tri-Clover Division of the Ladish Company of Kenosha, Wisconsin.

Thus, in accordance with the above the aforementioned objectives are effectively attained.

Having thus described the invention, what I claim is:

1. A multi-tube heat exchanger comprising:

a first tube;

a second tube disposed about and concentric with said first tube;

an end of said second tube;

a fitting disposed about said first tube and coupled to said end of said second tube;

a cap ring disposed about and secured to the outer surface of said first tube;

an end cap secured to an end of said fitting, said end cap having a bore of sufficient diameter to receive said first tube extending therethrough;

clamp means for securing said end cap in position and to urge said end cap into sealing engagement with said cap ring, said end cap and said clamp means having mating surfaces machined to complementary, inverted, chamfered surfaces, whereby, as said clamp is tightened said surfaces are urged against each other;

said clamp means comprising a split champ, said first tube includes as clamp ring disposed about the outer surface thereof; and said clamp further includes a groove extending about the inner surface thereof for capturing said clamp ring.

2. The heat exchanger in accordance with claim 1 wherein said cap ring and end cap have gasket receiving grooves machined into mating surfaces thereof and further comprising a gasket disposed within said grooves.

3. The heat exchanger in accordance with claim 2 wherein said fitting includes a product port extending therethrough.

4. The heat exchanger in accordance with claim 1 wherein said chamfered surfaces are tapered radially and said cap ring and end cap are axially spaced.

5. The heat exchanger of claim 4 wherein said clamp means includes two semicircular clamp segments and tightening means for urging said segments toward each other.

6. The heat exchanger of claim 1 wherein said cap ring is welded to said first tube.

7. The heat exchanger of claim 1 wherein said end cap is welded to said end of said fitting.

8. The heat exchanger of claim 1 wherein said clamp ring is welded to said first tube.

9. The heat exchanger of claim 1 wherein said first tube has a sidewall which is uninterrupted within said fitting whereby there is no fluid exchange between said fitting and said first tube.

* * * * *